US005558546A

United States Patent [19]

Chadbourne et al.

[11] Patent Number: 5,558,546

[45] Date of Patent: Sep. 24, 1996

[54] ELECTRICAL WEDGE CONNECTOR WITH PREINSTALLMENT INTERCONNECTOR

[75] Inventors: Richard Chadbourne, Merrimack; William J. Lasko, Libson; Gennaro L. Pecora, Manchester, all of N.H.

[73] Assignee: Burndy Corporation, Norwalk, Conn.

[21] Appl. No.: 353,459

[22] Filed: Dec. 9, 1994

[51] Int. Cl.[6] ..... H01R 4/50

[52] U.S. Cl. ..... 439/783; 439/863

[58] Field of Search ..... 439/783, 784, 439/863

[56] References Cited

U.S. PATENT DOCUMENTS

| | | | |
|---|---|---|---|
| 2,106,724 | 2/1938 | Cope | 173/273 |
| 2,814,025 | 11/1957 | Wade et al. . | |
| 2,828,147 | 3/1958 | Peiffer | 285/138 |
| 3,065,449 | 11/1962 | Matthysse et al. . | |
| 3,275,974 | 9/1966 | Mixon, Jr. . | |
| 3,329,928 | 7/1967 | Broske . | |
| 3,349,167 | 10/1967 | Mixon, Jr. et al. | 174/94 |
| 3,462,543 | 8/1969 | Wahl et al. | 174/94 |
| 3,504,332 | 3/1970 | Mixon, Jr. . | |
| 3,516,050 | 6/1970 | Mixon, Jr. et al. . | |
| 3,588,791 | 6/1971 | Polidori . | |
| 3,920,310 | 11/1975 | Walsh et al. . | |
| 4,059,333 | 11/1977 | Mixon, Jr. . | |
| 4,533,205 | 8/1985 | Frank . | |
| 4,600,264 | 7/1986 | Counsel . | |
| 4,634,205 | 1/1987 | Gemra . | |
| 4,650,273 | 3/1987 | Roosdrop . | |
| 4,723,920 | 2/1988 | Werner | 439/782 |
| 4,723,921 | 2/1988 | Pooley | 439/783 |
| 4,730,087 | 3/1988 | Werner | 174/94 S |
| 4,734,062 | 3/1988 | Goto | 439/783 |
| 4,813,894 | 3/1989 | Mixon, Jr. | 439/783 |
| 4,863,403 | 9/1989 | Shannon | 439/783 |
| 4,872,856 | 10/1989 | Pooley et al. | 439/783 |
| 4,915,653 | 4/1990 | Mair | 439/781 |
| 5,006,081 | 4/1991 | Counsel et al. | 439/783 |
| 5,044,996 | 9/1991 | Goto | 439/783 |
| 5,092,797 | 3/1992 | Cole et al. | 439/783 |
| 5,145,420 | 9/1992 | Counsel et al. | 439/783 |
| 5,244,422 | 9/1993 | Laricchia | 439/783 |
| 5,423,699 | 6/1995 | Johnson | 439/783 |

*Primary Examiner*—P. Austin Bradley
*Assistant Examiner*—Jill Demello
*Attorney, Agent, or Firm*—Perman & Green

[57] ABSTRACT

An electrical wedge connector with a sleeve, a separate wedge, and an interconnector. The interconnector connects the wedge to the sleeve when the wedge is not directly connected to the sleeve. This prevents the sleeve or wedge from being accidently lost or dropped prior to assembly. The interconnector can be flexible or rigid.

10 Claims, 2 Drawing Sheets

ELECTRICAL WEDGE CONNECTOR WITH PREINSTALLMENT INTERCONNECTOR

BACKGROUND OF THE INVENTION

1. Field of the Invention

The present invention relates to electrical connectors and, more particularly, to a wedge connector.

2. Prior Art

U.S. Pat. No. 4,650,273 discloses an electrical connector with a general "C" shaped sleeve and a wedge. The wedge is stamped and formed from sheet metal and has a tab at its front end. The tab engages a front end of the sleeve to resist withdrawal of the wedge from the sleeve. U.S. Pat. No. 5,006,081 discloses a wedge connector with a "C" shaped sleeve having a hole in its middle section for engaging a dimple on a stamped and formed sheet metal wedge. Other U.S. Patents that relate to wedge connectors include the following:

U.S. Pat. No. 2,106,724
U.S. Pat. No. 2,814,025
U.S. Pat. No. 2,828,147
U.S. Pat. No. 3,065,449
U.S. Pat. No. 3,275,974
U.S. Pat. No. 3,329,928
U.S. Pat. No. 3,349,167
U.S. Pat. No. 3,462,543
U.S. Pat. No. 3,504,332
U.S. Pat. No. 3,516,050
U.S. Pat. No. 3,588,791
U.S. Pat. No. 3,920,310
U.S. Pat. No. 4,059,333
U.S. Pat. No. 4,533,205
U.S. Pat. No. 4,600,264
U.S. Pat. No. 4,634,205
U.S. Pat. No. 4,723,920
U.S. Pat. No. 4,723,921
U.S. Pat. No. 4,730,087
U.S. Pat. No. 4,734,062
U.S. Pat. No. 4,813,894
U.S. Pat. No. 4,863,403
U.S. Pat. No. 4,872,856
U.S. Pat. No. 4,915,653
U.S. Pat. No. 5,044,996
U.S. Pat. No. 5,145,420
U.S. Pat. No. 5,244,422

SUMMARY OF THE INVENTION

In accordance with one embodiment of the present invention, an electrical wedge connector is provided comprising a sleeve, a wedge, and an interconnector. The interconnector connects the wedge to the sleeve before the wedge is directly connected to the sleeve.

In accordance with another embodiment of the present invention, an electrical wedge connector is provided comprising a sleeve, a wedge, and means for retaining the wedge with the sleeve. The means for retaining is adapted to retain the wedge with the sleeve prior to the wedge being installed into the sleeve.

In accordance with one method of the present invention, a method of manufacturing an electrical wedge connector is provided comprising the steps of providing a sleeve and a separate wedge; and connecting the wedge to the sleeve without inserting the wedge into the sleeve.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
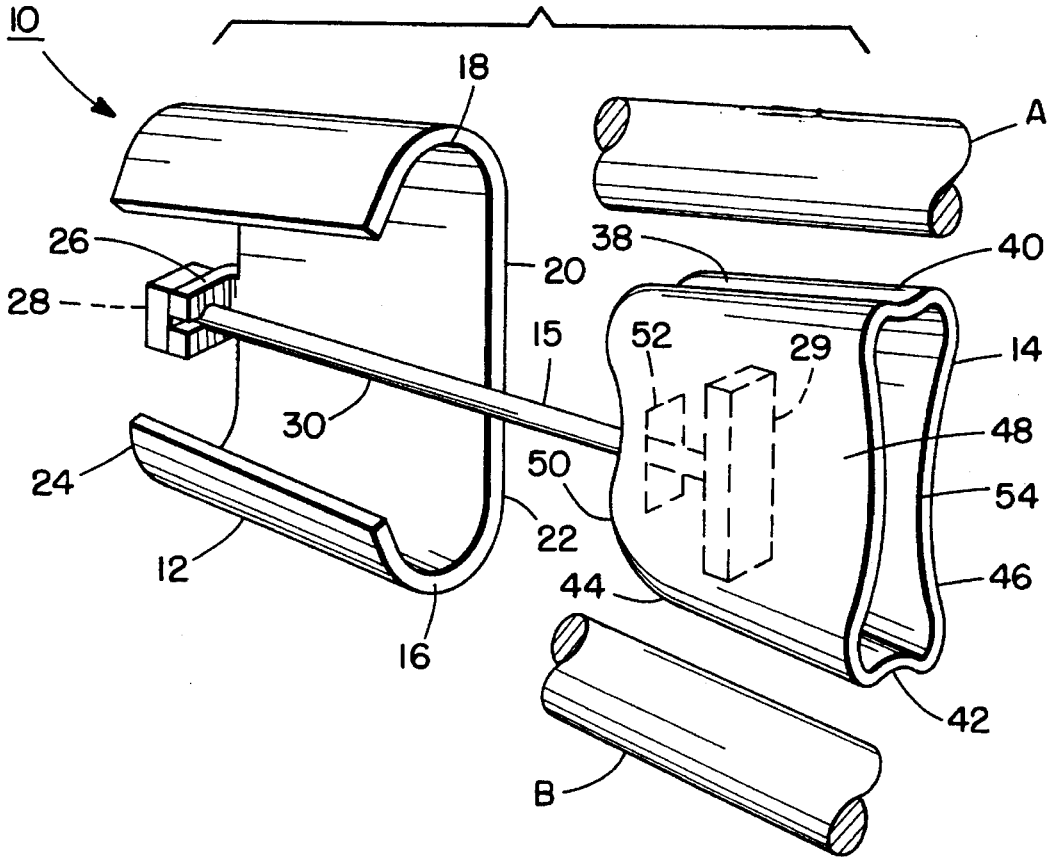
FIG. 1 is an exploded perspective view of an electrical connector incorporating features of the present invention and two conductors.

Referring to FIG. 1, there is shown an exploded perspective view of a wedge connector 10 for connecting two electrical conductors A, B together. Although the present invention will be described with reference to the embodiments shown in the drawings, it should be understood that the present invention can be embodied in many alternate embodiments. In addition, any suitable size, shape or type of elements or materials could be used.

The connector 10 generally comprises a connector sleeve or shell 12, a wedge 14 and an interconnector 15. The sleeve 12 is preferably made of metal, but it could also be made of other materials. The sleeve 12 has two opposing channel sections 16, 18 interconnected by a middle section 20 to form a general cross-sectional "C" shape. The "C" shape tapers from the rear end 22 to the front end 24. Located at the front end 24 is an inwardly projecting mount 26 for the interconnector 15.

Figure 1A:
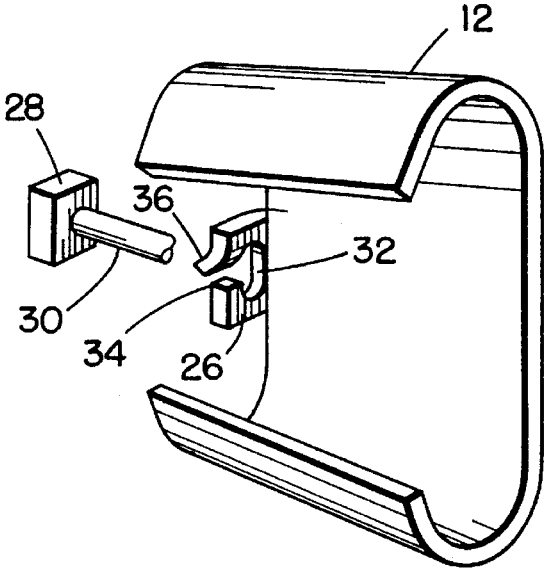
FIGS. 1A and 1B are a perspective views of the sleeve of the electrical connector shown in FIG. 1 showing how the interconnector is connected to the sleeve.
Figure 1B:
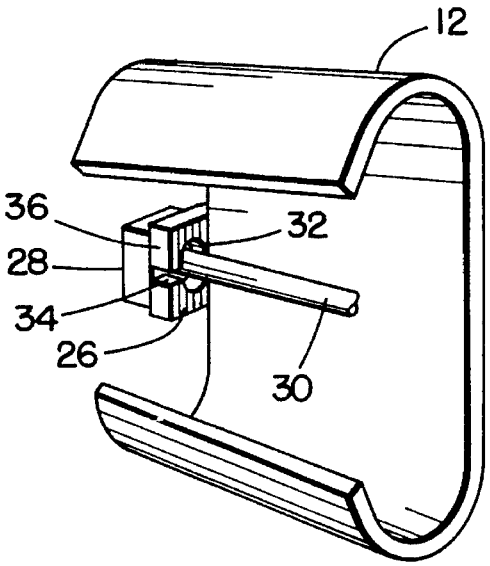

The interconnector 15 is preferably comprised of elastic or rubber material. In the embodiment shown, the interconnector 15 has two enlarged ends 28, 29 with an elastic stretch cord 30 therebetween. In an alternate embodiment the cord 30 could be comprised of a non-elastic and/or rigid member such as made with plastic or metal material. Referring also to FIGS. 1A and 1B, the method of fixedly attaching the interconnector 15 to the mount 26 will be described. Before assembly, as seen in FIG. 1A, the mount 26 has a hole 32 and a slot 34 formed by a bent finger 36. The hole 32 and slot 34 are suitably sized and shaped to allow the cord 30 to be laterally passed through the slot 34 into the hole 32. Once the cord 30 is located in the hole 32, the bent finger 36 is deformed or straightened to substantially close the slot 34. This prevents the cord 30 from being laterally withdrawn from the hole 32. The end 28 of the interconnector 15 is larger than the hole 32. In the embodiment shown, the cord 30 is smaller than the hole 32 such that the cord 30 can longitudinally move in the hole 32. However, in an alternate embodiment, the interconnector 15 could be stationarily fixed to the mount 26. The opposite end of the interconnector 15 is attached to the wedge 14. In alternate embodiments other types of suitable sleeves and/or interconnectors could be provided.

The wedge 14 is a one-piece member preferably made of drawn metal. The wedge 14 is suitably size and shaped to be inserted into the sleeve 12 and wedge the conductors A, B against the sleeve 12 at the channel sections 16, 18. The wedge 14 has a general tubular wedge shape or general cone shape with a substantially hollow interior, a conductor contacting surface 38 on a first top side 40, a conductor contacting surface 42 on a second bottom side 44, a third side 46 and a fourth side 48. The front 50 of the wedge 14 is substantially enclosed except for a hole 52. The rear 54 of the wedge 14 is substantially open. However, in alternate embodiments, other types of wedges could be used. The hole 52 has the cord 30 passing therethrough. In this embodiment the hole 52 is suitably sized and shaped to allow the cord 30 to longitudinally move therein. The end 29 is larger than the hole 52. Because the ends 28, 29 of the interconnector 15 are larger than the holes 32, 52, the interconnector 15 fixedly connects the sleeve 12 and wedge 14 to each other. However, this is not a stationary connection of the wedge 14 to the sleeve 12. The wedge 14 can be moved relative to the sleeve 12. More specifically, the wedge 14 can be inserted into sleeve 12 to sandwich the conductors A, B against the channel sections 16, 18. In a preferred embodiment, the hole 52 is suitably sized and shaped to allow the end 28 to be passed therethrough during assembly. Alternatively, the hole 52 could be substantially the same size as the cord 30 with the ends 28 and/or 29 being attached to the cord 30 after the cord 30 is positioned in the hole 52. If the interconnector 15 is a rigid member, the hole 52 allows the wedge 14 to be slidable along the interconnector into the sleeve 12. Alternatively, or additionally, the sleeve 12 could be slidable along such a rigid interconnector. The method of manufacturing the electrical wedge connector 10 comprises steps of providing a separate sleeve and separate wedge; and connecting the wedge to the sleeve by use of the interconnector without inserting the wedge into the sleeve. Any suitable type of means (moveable or stationary) could be used to fasten or attach the interconnector to the wedge and sleeve. In addition, the interconnector could be attached at any suitable location on the sleeve and/or wedge.

The present invention provides a unique electrical wedge connector assembly in which, prior to final direct connection of the wedge to the sleeve, the wedge and sleeve are indirectly connected to each other by the interconnector. The interconnector connects the wedge to the sleeve when the wedge is not directly connected to the sleeve. Thus, the wedge and sleeve cannot be inadvertently separated from each other. This allows installers of connectors to store a multitude of such connectors in a single bin or container, including different size connectors without risk that wedges and sleeves of different sizes could be used with each other or, that a wedge, or sleeve could be lost from its corresponding mating member, or that a wedge from a first type of connector could be inadvertently used with a mistaken sleeve of a different type of second type of connector. This also aids an installer by holding the connector assembly in place prior to locking the wedge and sleeve together. The installer can use one hand without concern of parts falling to the ground.

Figure 2:
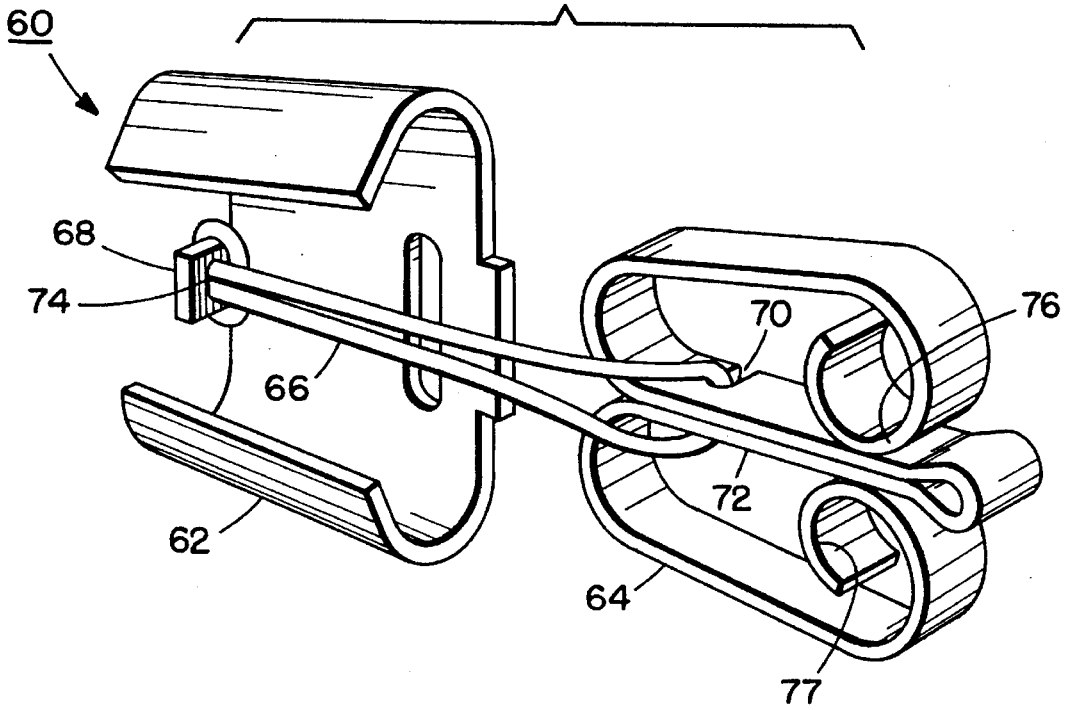
FIG. 2 is a perspective view of an alternate embodiment of the electrical connector.

Referring now to FIG. 2 an alternate embodiment of an electrical connector 60 is shown. The sleeve 62 and wedge 64 are substantially the same as those disclosed in U.S. patent application Ser. No. 08/306,463 filed Sep. 15, 1994, which is hereby incorporated by reference in its entirety, with three main exceptions. First, the connector 60 has an interconnector 66. Second, the sleeve 62 has a front mount 68. Third, the wedge 64 has a notch 70 in its middle 72. The interconnector 66 in this embodiment is a flexible cord in the form of an enclosed circle, such as a rubber band or plastic loop. The mount 68 has a hole 74. The cord 66 is looped over the mount 68 and then passed through the hole 74 to attach the cord 66 to the mount 68. The opposite end of the cord 66 is looped over the middle 72 of the wedge 64 between the looped ends 76, 77 and the middle 72. The opposite end can then be positioned in the notch 70.

Figure 2A:
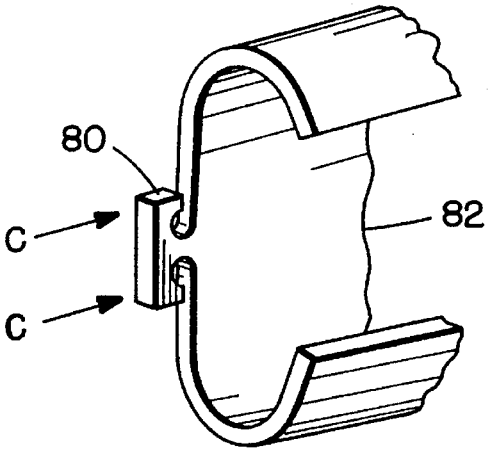
FIG. 2A is a front end perspective view of an alternate embodiment of the sleeve of the electrical connector.

Referring now to FIG. 2A, an alternate embodiment of the front mount 80 on a sleeve 82 is shown. In this embodiment the mount 80 has a general "T" shape that extends forward rather than inwardly. The interconnector can be looped around the mount 80 and the ends of the "T" shape deformed as indicated by arrows C. This will fixedly and stationarily attach the mount 80 to the cord.

Figure 3:
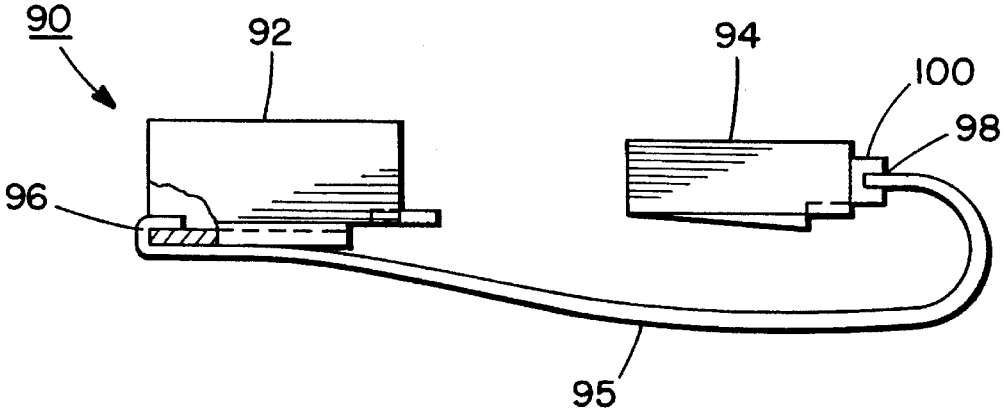
FIG. 3 is an elevational side view with a cut-away section of an alternate embodiment of the electrical connector.

Referring now to FIG. 3, an alternate embodiment of an electrical connector 90 is shown. The wedge 94 and sleeve 92 are substantially similar to those shown in FIG. 2. However, in this embodiment the sleeve 92 does not have a mount. The cord 95 is not a closed loop. The cord is a flexible string or tie. One end 96 of the cord 95 is stationarily attached to the front end of the sleeve 92 by adhesive. The opposite end 98 of the cord 95 is fixedly attached to the rear of the wedge 94 at the middle rear loop 100 such as by being located in a hole in the loop 100 and having a knot tied in the end 98 to prevent removal of the cord 95 from the hole. However, any suitable means could be used to connect the cord to the sleeve and wedge.

Once the electrical connector is finally assembled with the wedge inside the sleeve and sandwiches the conductors against the sleeve, the interconnector can be removed or left in place. The wedge and sleeve could be suitably designed to automatically cut or otherwise remove, the interconnector during final assembly if desired. If the interconnector is intended to be left attached to the sleeve and/or wedge, the interconnector could also be designed to be used as a fastening tie to attach the connector to another member or structure.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a sleeve;

a wedge; and an interconnector that connects the wedge to the sleeve when the wedge is not directly connected to the sleeve, the interconnector comprising a flexible cord.

2. A connector as in claim 1 wherein the cord is elastic.

3. A connector as in claim 1 wherein the interconnector is connected to a front end of the sleeve and a front end of the wedge.

4. A connector as in claim 1 wherein the interconnector is stationarily fixedly connected to a front end of the sleeve.

5. A connector as in claim 1 wherein the interconnector is fixedly connected to a rear end of the wedge.

6. An electrical wedge connector comprising:

a sleeve;

a wedge; and means for retaining the wedge with the sleeve prior to the wedge being inserted into the sleeve, wherein the means for retaining comprises a flexible cord connecting the wedge to the sleeve.

7. A connector as in claim 6 wherein the flexible cord is elastic.

8. A method of manufacturing an electrical wedge connector comprising steps of:

providing a sleeve and a separate wedge; and connecting the wedge to the sleeve without inserting the wedge into the sleeve, wherein the step of connecting the wedge to the sleeve comprises attaching a flexible interconnector between the sleeve and wedge.

9. A method as in claim 8 wherein the step of connecting comprises attaching one end of the interconnector to a front end of the sleeve.

10. A method as in claim 8 wherein the step of connecting comprises attaching one end of the interconnector to a front end of the wedge.

* * * * *